US005188345A

United States Patent [19]

Siegner et al.

[11] Patent Number: 5,188,345

[45] Date of Patent: Feb. 23, 1993

[54] LOCKABLE ELEVATING MECHANISM FOR THE CONTINUOUS ADJUSTMENT OF CHAIR SEATS

[75] Inventors: Helge Siegner; Ludwig Stadelmann, both of Altdorf; Herbert Wolf, Nürnberg, all of Fed. Rep. of Germany

[73] Assignee: Suspa Compart Aktiengesellschaft, Fed. Rep. of Germany

[21] Appl. No.: 876,143

[22] Filed: Apr. 30, 1992

[30] Foreign Application Priority Data

May 1, 1991 [DE] Fed. Rep. of Germany ..... 4114227
Mar. 10, 1992 [DE] Fed. Rep. of Germany ..... 4207470

[51] Int. Cl.[5] ..... A47C 3/30; A47B 9/10

[52] U.S. Cl. ..... 267/131; 188/300; 188/322.18

[58] Field of Search ..... 267/64.12, 64.22, 64.26, 267/131; 188/300, 322.18; 248/161, 354.1, 631; 297/345, 347

[56] References Cited

U.S. PATENT DOCUMENTS 3,656,593 4/1972 Bauer ..... 188/300
3,711,054 1/1973 Bauer ..... 248/400
4,245,826 1/1981 Wirges ..... 297/345
4,756,496 7/1988 Hosan et al. ..... 297/345
4,964,625 10/1990 Kawamura ..... 188/300
4,969,619 11/1990 Bauer et al. ..... 248/161
4,979,718 12/1990 Bauer et al. ..... 188/322.18

FOREIGN PATENT DOCUMENTS 2542182 3/1977 Fed. Rep. of Germany .
7833768 4/1979 Fed. Rep. of Germany .
3322796 1/1985 Fed. Rep. of Germany .
3932146 4/1991 Fed. Rep. of Germany .

*Primary Examiner*—Robert J. Oberleitner
*Assistant Examiner*—Chris Schwartz

[57] ABSTRACT

In a lockable elevating mechanism for the continuous adjustment of chair seats a guide tube is provided, to the bottom plate of which is secured a piston rod of a longitudinally adjustable gas spring. The guide tube is provided with an additional tube, which can be exited telescopically and and which is guided in a guide bush arrested in the guide tube. The housing of the gas spring is in turn guided in a guide bush arrested in the additional tube. A mechanical spring is provided between the guide tube and the additional tube and acts upon the additional tube in a direction out of the guide tube.

8 Claims, 2 Drawing Sheets

LOCKABLE ELEVATING MECHANISM FOR THE CONTINUOUS ADJUSTMENT OF CHAIR SEATS

FIELD OF THE INVENTION

The invention relates to a lockable elevating mechanism for the continuous adjustment of chair seats comprising a guide tube to be connected with a pedestal and a longitudinally adjustable, lockable gas spring, of which the piston rod is axially tightly, but releasably connected with a bottom plate of the guide tube and of which the housing is guided in the guide tube and is axially tightly connectable with a chair seat at the end opposite to the piston rod and is displaceable laterally without substantial play and in the direction of a common longitudinal axis.

BACKGROUND OF THE INVENTION

In an elevating mechanism of the generic type known from U.S. Pat. No. 3,711,054 the cylindrical surface of the housing of the gas spring is directly guided in a guide bush connected with the guide tube. The gas spring is not only the supporting and longitudinally adjustable element but also the guiding and rotatable element of a chair or table column. Since the piston rod is secured in the bottom plate of the guide tube not only for free rotation but also with sufficient radial play, the gas spring can adjust to any possible and changing load directions of the seat or the table-top, whereby the risk of bracing within the guide bush is eliminated.

Longitudinally adjustable gas springs of the type used for this purpose are known from U.S. Pat. No. 3,656,593. These gas springs can have an additional protecting tube tightly connected with their housing, as it is known from U.S. Pat. No. 4,979,718.

In these known mechanisms the gas spring is the most expensive component in terms of construction and costs. Consequently, it is desirable that as many different chairs, tables or the like as possible be realized with types of gas springs that differ as little as possible. Constructive limits are set by the maximum travel defined by the above-described design.

SUMMARY OF THE INVENTION

It is accordingly an object of the invention to extend the travel of mechanisms of the generic type without interfering with the construction of the gas spring.

In accordance with the invention this object is attained by the features that a first guide bush is arranged between the housing and an additional tube, so that the housing is supported for displacement relative to the additional tube in the direction of the longitudinal axis, that a second guide bush is arranged between the additional tube and the guide tube and is arrested in relation to the guide tube in the direction of the longitudinal axis so that the additional tube is in turn displaceable while axially guided in relation to the guide tube, that a mechanical helical compression spring is provided between the additional tube and the guide tube and acts upon the additional tube in a direction away from the bottom plate of the guide tube to the housing. According to the invention a telescopic arrangement is provided to combine with a mechanical spring in addition to the gas spring by reason of an additional tube permitting extended travel. If loaded from the top, i.e. if for instance somebody sits down on the seat, the elevating mechanism is reduced in length in that at first the housing of the gas spring is displaced in relation to the piston rod, until for instance the seat carrier or some other stop axially firmly arranged on the housing of the gas spring comes to bear against the upper front of the additional tube or of the first guide bush used there. It is only the force of the gas spring that acts during this travel. When this abutment position has been reached, a second spring travel is covered, namely against the resilient effect of the mechanical spring and the force of the gas spring, until either a further stop is reached or the mechanical spring cannot be compressed any more thus itself forming the stop.

The mechanical spring is advantageously embodied as a helical compression spring, so that it can be favourably arranged in the vicinity of the additional tube or of the guide tube, respectively.

In a first advantageous embodiment it is provided that while surrounding the upper end of the additional tube the helical spring is arranged between an annular collar at the free end of the additional tube and the front end of the guide tube. This annular collar can be realized simply by the upper end of the additional tube being bent over. The opposite stop of the helical spring is formed by the second guide bush or by the external rim of the guide tube.

As an alternative of this embodiment it can be provided that the helical spring is arranged inside the guide tube and bears against the lower front of the additional tube on the one hand and against an internal stop of the guide tube on the other hand. This stop can be a separate annular collar or also for instance the bottom plate of the guide tube.

The additional tube may advantageously have an abutment end gripping from behind a rim of the second guide bush facing the bottom plate. This is a simple possibility of arresting the second guide bush in relation to the additional tube.

The abutment end can be formed by an expansion of the corresponding end of the additional tube or according to another advantageous embodiment it can grip the second guide bush from behind elastically resiliently and radially referred to the central longitudinal axis.

It can further be advantageously provided that in the vicinity of its upper end facing away from the bottom plate of the guide tube the second guide bush has at least one elastic retaining projection cooperating with a projection at the upper rim of the guide tube to form a safeguard against axial displacement.

For realization of a defined stop a thrust ring may be provided on the external surface of the housing of the gas spring in the vicinity of where a seat carrier is secured.

Further details, advantages and features of the invention will become apparent from the ensuing description of two examples of embodiment taken in conjunction with the drawing.

DESCRIPTION OF THE PREFERRED EMBODIMENTS

Figure 1:
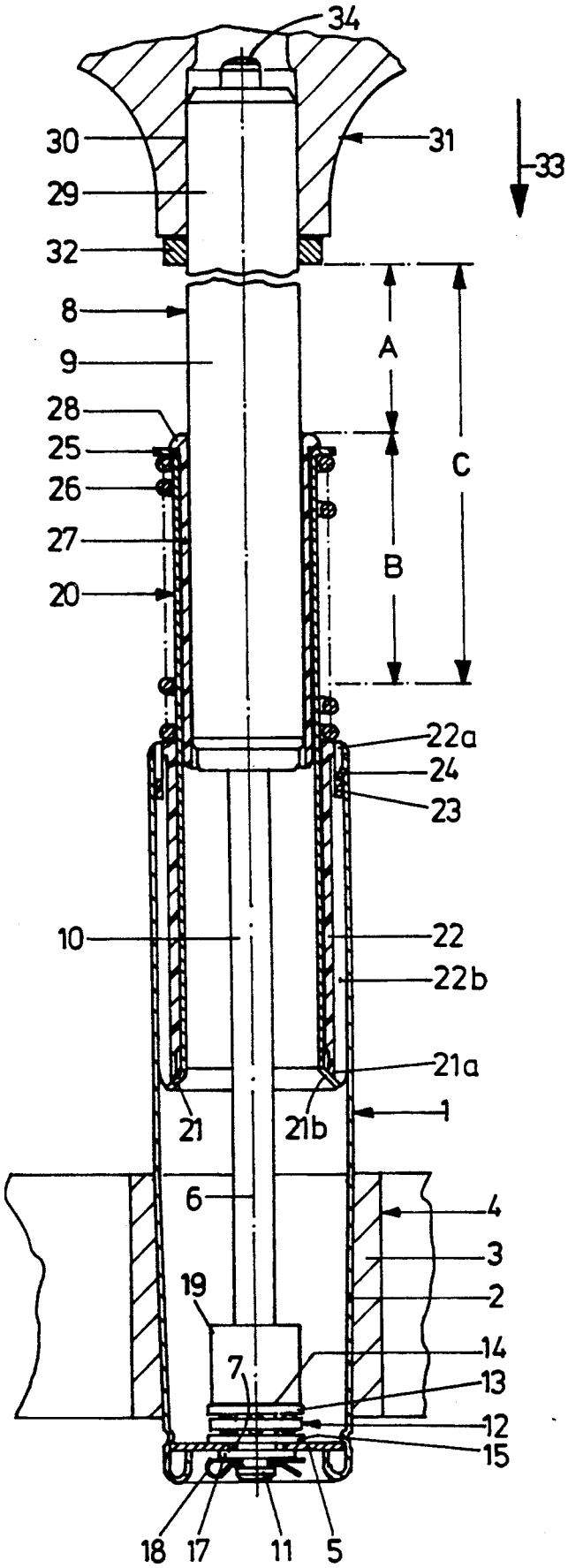
FIG. 1 is a longitudinal section through an elevating mechanism in the form of a chair column.

An elevating mechanism illustrated in FIG. comprises a lower guide tube 1 of essentially cylindrical design, its lower portion having a section 2 conically tapering downwards for engagement with a corresponding hub 3 of a pedestal.

At its lower end the guide tube 1 is provided with a bottom plate 5 having an opening 7 concentrical of the central longitudinal axis 6 of the whole elevating mechanism and thus also of the guide tube 1.

A longitudinally adjustable gas spring 8 hydraulically of pneumatically lockable is provided equally concentrically of the longitudinal axis 6 and has a cylindrical housing 9 extending in or beyond the upper portion of the guide tube 1. The associated piston rod 10 projects downwards out of the housing 9 and is releasably attached to the bottom plate 5. To this effect the free end of the piston rod 10 is designed to have a journal 11 of reduced cross-section to which applies a thrust ball bearing 12 of which the upper track ring 13 bears against the annular collar 14 formed at the junction between the journal 11 and the piston rod 10, whereas the lower track ring 15 bears against the bottom plate 5.

The journal 11 passes through the opening 7 with sufficient radial play of between some tenths of a millimeter and a millimeter, so that the piston rod 10 is not radially braced in relation to the guide tube 1. A shim 17 of a diameter larger than that of the opening 7 is placed onto the journal 11 from outside, i.e. from below. A retaining element 18 is placed in between, such that the piston rod 10 of the gas spring is axially firmly but releasably connected with the guide tube 1. An approximately annular cylindrical end position damper or stop damper 19 of rubber is located on the piston rod 10 and bears with its lower side against the upper track ring 13 of the thrust ball bearing 12. The embodiment so far specified is known from U.S. Pat. No. 4,969,619.

An additional tube 20 is introduced into the guide tube 1 from the latter's top.

At its lower end the additional tube 20 is bent over outwards thus forming an abutment end 21. The abutment end 21 bears against a rim 21*a* of a guide bush 22 of plastic material facing the bottom plate 5. On its portion opposite the rim 21*a* the guide bush 22 has resilient retaining projections 23 radial to the central longitudinal axis 6. On the upper free end of the guide tube 1 projections 24 directed inwards are provided and are gripped from behind by the resilient retaining projections 23 thus forming an axial stop for the latter. This serves to prevent the additional tube 20 with the guide bush 22 from exiting axially upwards out of the guide tube 1. The abutment end 21 is provided with slits 21*b* so that the additional tube 20 can be introduced into the guide bush 22. Upon this the abutment end 21 is elastically deformed towards the central longitudinal axis 6 and elastically expands at the end of the introducing process so that it is then located behind the rim 21*a*. Alternately it is of course possible to bend the abutment end 21 over with an appropriate tool after introduction of the additional tube 20 into the guide bush 22. The guide bush 22 is protected from being pushed into the guide tube 1 by a stop collar 22*a* that bears against the upper free rim of the guide tube 1. Thus the guide bush 22 is arrested in the guide tube 1 in both directions of the central longitudinal axis 6. The guide bush 22 radially bears against the guide tube 1 in known manner by means of ribs 22*b*.

The free upper end of the additional tube 20 is bent over outwards forming an annular collar 25. A helical compression spring 26 bears against the lower side of this annular collar 25 on the one hand and, on the other hand, against the upper side or front of the guide bush 22 arrested in the guide tube 1, consequently pressing the additional tube 20 into an exiting position in the direction away from the bottom plate 5, i.e. into the position shown in FIG. 1, in which the abutment end 21 rests against the associated rim 21*a* of the guide bush 22.

Inside the upper portion of the additional tube 20 a further guide bush 27 is arranged bearing with a beaded edge 28 against the annular collar 25 of the additional tube 20, thus being protected from sliding axially into the additional tube 20. The housing 9 of the gas spring 8 is supported in the guide bush 27 for axial displacement in the direction of the central longitudinal axis 6.

On its free end facing away from the bottom plate 5 the housing 9 is provided with a conical securing section 29, which engages with a retaining cone 30 of a seat carrier 31 outlined only diagrammatically. Further a thrust ring 32 is placed axially non-displaceably on the external surface of the housing below the securing section 29.

An actuating pin 34 projects over the securing section 29, by means of which a valve located in the housing 9 of the gas spring 8 can be opened or closed. If the valve is closed, the gas spring is largely blocked, i.e. free displacement of the piston rod 10 relative to the housing 9 is not possible. If, however, the valve is opened by the actuaing pin 34 being pushed in, the total length of the gas spring can be modified by the piston rod 10 entering or exiting the housing the housing 9. Longitudinally adjustable or lockable gas spring 8 of this type of generally known, for instance from U.S. Pat. No. 3,656,593.

Proceeding from the position shown in FIG. 1, in which the piston rod 10 has completely exited the housing 9 so that the elevating mechnism has its maximum length, the operating mode is as follows. Length adjustment of the gas spring 8 takes place when the acutaing pin 34 is pushed into the latter's housing 9. When the chair column is loaded from the top in the direction of the arrow 33 first the housing 9 of the gas spring 8 is displaced in the guide bush 27 by the travel A, until the lower side of the thrust ring 32 or such a ring not being provided the lower edge of the seat carrier 31 comes to bear against the annular collar 25 or the beaded edge 28. This travel A being covered the additional tube 20 is displaced in relation to the guide bush 22 by compression of the helical spring 26 until the latter is completely compressed. A travel B has now been covered. As compared with conventional chair columns a prolonged total travel C formed by the sum of A+B is thus attained without any modification of the gas spring 8 itself. The total travel C of the elevating mechanism can be made comparatively long, sufficient guidance of the housing 9 of the gas spring still being assured even when the gas spring is in a largely or completely exited condition.

Figure 2:
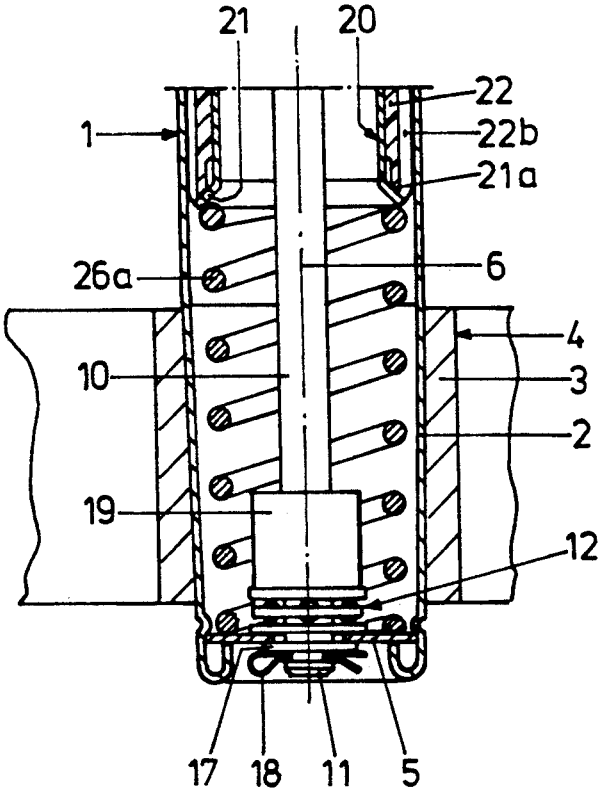
FIG. 2 is a longitudinal section through the lower part of an elevating mechanism modified as compared with FIG. 1.

FIG. 2 shows an embodiment with no helical compression spring arranged between the annular collar 25 of the additional tube 20 and the front of the guide bush 22. Rather, this embodiment comprises a helical compression spring 26*a* bearing against the bottom plate 5 on the one hand and against the abutment end 21 of the additional tube on the other hand. This, too, has the effect that the additional tube 20 is acted upon in a direction away from the bottom plate 5 of the guide tube 1. Apart from the difference residing in that no helical compression spring is provided the elevating mechanism according to FIG. 2 is identical with that of FIG. 1 so that only the lower portion has to be illustrated.

Due to the fact that a force is needed to compress the helical compression spring 26 or 26a when the additional tube 20 is telescopically entered into the guide tube 1, the total spring characteristic of the gas spring 8 on the one hand and the helical compression spring 26 or 26a on the other hand becomes steeper. So, in particular with a heavy person sitting on the seat carried by the seat carrier 31 during length adjustment of the gas spring, the housing 9 of the gas spring 8 will contact the stop damper 19 in a manner relieved by the described forces. The longitudinal adjustment during the travel B is damped by stronger spring action and resiliently.

What is claimed is:

1. A lockable elevating mechanism for the continuous adjustment of chair seats comprising a guide tube (1) to be connected with a pedestal (4) and having a bottom plate (5)

a longitudinally adjustable, lockable gas spring (8), which has a central longitudinal axis (6) and a piston rod (10), which in a direction of said axis (6) is tightly, but releasably connected with said bottom plate (5) of said guide tube (1), and which gas spring (8) has a housing (9), which is guided in said guide tube (1) and which in the direction of said axis (6) is tightly connectable with a chair seat (31) at an end opposite to said piston rod (10), and which housing (9) is displaceably guided in the direction of said common longitudinal axis (6) and is guided in said guide tube (1) without substantial play radially to the direction of said common longitudinal axis (6), wherein a first guide bush (27) is arranged between said housing (9) and an additional tube (20), so that said housing (9) is supported for displacement relative to said additional tube (20) in the direction of said longitudinal axis (6), wherein a second guide bush (22) is arranged between said additional tube (20) and said guide tube (1) and is arrested in relation to said guide tube (1) in the direction of said longitudinal axis (6) so that said additional tube (20) is in turn displaceable while axially guided in relation to said guide tube (1), and wherein a mechanical helical compression spring (26, 26a) is provided between said additional tube (20) and said guide tube (1) and acts upon said additional tube (20) in a direction away from said bottom plate (5) of said guide tube (1) to said housing (9).

2. An elevating mechanism according to claim 1, wherein said mechanical spring is a helical compression spring (26, 26a).

3. An elevating mechanism according to claim 2, wherein while surrounding an upper end of said additional tube (20) said helical compression spring (26) is arranged between a stop (25) at a free end of said additional tube (20) and a front end of said guide tube (1).

4. An elevating mechanism according to claim 2, wherein said helical spring (26a) is arranged inside said guide tube (1) and bears against a lower front of said additional tube (20) on the one hand and against an internal stop (5) of said guide tube (1) on the other hand.

5. An elevating mechanism according to claim 1, wherein said additional tube (20) has an abutment end (21) gripping from behind a rim (21a of said second guide bush (22) facing said bottom plate (5).

6. An elevating mechanism according to claim 5, wherein said abutment end (21) grips said second guide bush (22) elastically resiliently and radially in relation to said central longitudinal axis (6).

7. Al elevating mechanism according to claim 1, wherein in the vicinity of an upper end facing away from said bottom plate (5) of said guide tube (1) said second guide bush (22) has at least one elastic retaining projection (23) cooperating with a projection (24) at an upper rim of said guide tube (1) to form a safeguard against axial displacement.

8. An elevating mechanism according to claim 1, wherein a thrust ring (32) is provided on the external surface of the housing (9) in the vicinity of where said seat carrier (31) is securable.

* * * * *